United States Patent [19]

Wendt

[11] Patent Number: 4,806,175

[45] Date of Patent: Feb. 21, 1989

[54] METHOD OF SURFACE HARDENING FERROUS WORKPIECES

[75] Inventor: Ulrich Wendt, Reinbeck, Fed. Rep. of Germany

[73] Assignee: Körber AG, Hamburg, Fed. Rep. of Germany

[21] Appl. No.: 786,350

[22] Filed: Oct. 10, 1985

Related U.S. Application Data

[63] Continuation of Ser. No. 622,777, Jun. 21, 1984, abandoned.

[30] Foreign Application Priority Data

Jun. 25, 1983 [DE] Fed. Rep. of Germany ..... 3322957

[51] Int. Cl.[4] ..... C21D 1/74

[52] U.S. Cl. ..... 148/16.5; 148/16.6

[58] Field of Search ..... 148/16.5, 16.6, 16, 148/127, 6, 6.03, 6.35; 204/164, 177, 173

[56] References Cited

U.S. PATENT DOCUMENTS

| | | | |
|---|---|---|---|
| 3,809,583 | 5/1974 | Krzyminski | 148/6 |
| 4,011,107 | 3/1977 | Hayes | 148/6 |
| 4,126,488 | 11/1978 | Kunst et al. | 148/6 |
| 4,394,234 | 7/1983 | Asahi | 204/164 |

FOREIGN PATENT DOCUMENTS

| | | | |
|---|---|---|---|
| 30620 | 8/1974 | Japan | 148/16.5 |
| 95838 | 8/1978 | Japan | 148/16.6 |
| 119164 | 9/1980 | Japan | 148/16.6 |

*Primary Examiner*—Christopher W. Brody
*Attorney, Agent, or Firm*—Peter K. Kontler

[57] ABSTRACT

Ferrous workpieces are surface-hardened in two stages the first of which involves confinement in a boron-containing pulverulent or pasty treating medium and heating to a temperature at which the workpiece develops a surface layer of iron boride. The thus treated workpiece is thereupon inserted into a vacuum furnace onto a cathode and is heated to a temperature of between 600°and 950° C. After heating up of the workpiece, the furnace receives a stream of nitrogen-containing gas while the heated workpiece is maintained in the plasma that develops as a result of glow discharge between the cathode and an anode so that the workpiece is nitrided. If the workpiece is to be carburized in lieu of nitriding, the temperature in the vacuum furnace can be raised to 1050° C. and the nitrogen-containing gas is replaced with methane or another suitable gaseous fluid.

6 Claims, 1 Drawing Sheet

METHOD OF SURFACE HARDENING FERROUS WORKPIECES

This application is a continuation of application Ser. No. 622,777, filed June 21, 1984, now abandoned.

BACKGROUND OF THE INVENTION

The present invention relates to improvements in methods of hardening workpieces which contain or consist of a ferrous material, and more particularly to improvements in a method of surface hardening workpieces which consist of iron, steel or other ferrous materials.

It is already known to surface harden ferrous workpieces by forming on their surfaces boron nitride crystals in specially designed vacuum furnaces as a result of deposition of boron and nitrogen which are freed from their compounds. A drawback of such conventional methods of enhancing the resistance to wear by hardening the surfaces of ferrous workpieces is that they are complex and expensive.

OBJECTS AND SUMMARY OF THE INVENTION

An object of the invention is to provide a novel and improved method of surface hardening workpieces consisting of or containing ferrous materials which is less expensive and less complex than heretofore known methods.

Another object of the invention is to provide a novel and improved method of treating pretreated ferrous workpieces for the purpose of further enhancing their hardness and resistance to wear.

A further object of the invention is to provide a method which can be practiced for superior surface treatment of a wide variety of ferrous workpieces.

Still another object of the invention is to provide apparatus for the practice of the above outlined method.

An additional object of the invention is to provide workpieces which are surface treated in accordance with the above outlined method.

The improved method comprises a first step of treating the surface of a ferrous workpiece with boron to form iron boride, and a second step of nitriding or carburizing the thus treated surface.

The first step can comprise confining the workpiece in a boron-containing medium and heating the medium and the workpiece. The medium may be of pulverulent or pasty consistency i.e., the medium can be a more or less freely flowable solid substance or it may contain a binder so that it constitutes or exhibits the characteristics of a paste. More specifically, the second step can include positioning the workpiece in the plasma of a glow discharge (e.g., by placing the workpiece onto a cathode in a vacuum furnace wherein the cathode and the workpiece thereon are spaced apart from an anode and applying a high-voltage energy to the two electrodes), and heating the workpiece to a temperature of between 600° and 1050° C., preferably to approximately 950°.

The novel features which are considered as characteristic of the invention are set forth in particular in the appended claims. The improved method itself, however, together with additional features and advantages thereof, will be best understood upon perusal of the following detailed description of certain specific embodiments of an apparatus for its practice with reference to the accompanying drawing.

DESCRIPTION OF THE PREFERRED EMBODIMENTS

Figure 1:
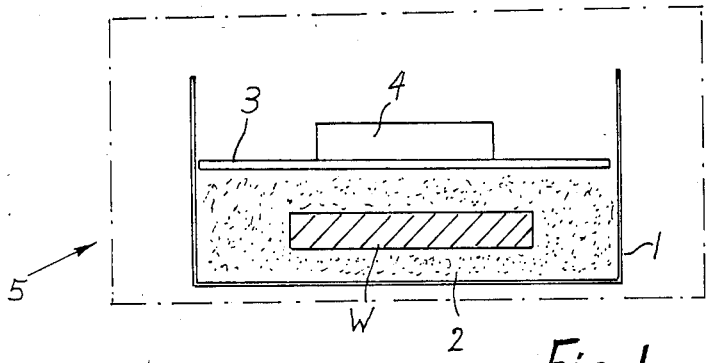
FIG. 1 is a schematic vertical sectional view of one embodiment of that portion of the apparatus which is utilized to provide the surface of the ferrous workpiece with a layer of iron boride.

FIG. 1 shows a flat plate- or block-shaped workpiece W of ferrous material (such as iron or steel) which is confined in a boron-containing medium 2 in the interior of an annealing box 1. The reference character 3 denotes a plate-like cover or lid which is placed on top of the flowable (pulverulent) treating medium and carries a weight or mass 4. The medium 2 in the box 1 preferably consists of or contains boron carbide.

The box 1 is inserted into an annealing furnace 5 which can constitute a conventional chamber oven or retort furnace, and the box is heated in the furnace to a temperature of between 850° and 1050° C., e.g., to a temperature of 950° C. The treatment is completed when the workpiece W develops a desired surface layer of iron boride.

In accordance with a modification of the just described treatment with a pulverulent boroncontaining medium, the exterior of the workpiece W can be coated with a paste which contains boron. The paste is allowed to dry and the workpiece is then inserted into a retort and heated in a protective gas (e.g., argon) atmosphere.

Figure 2:
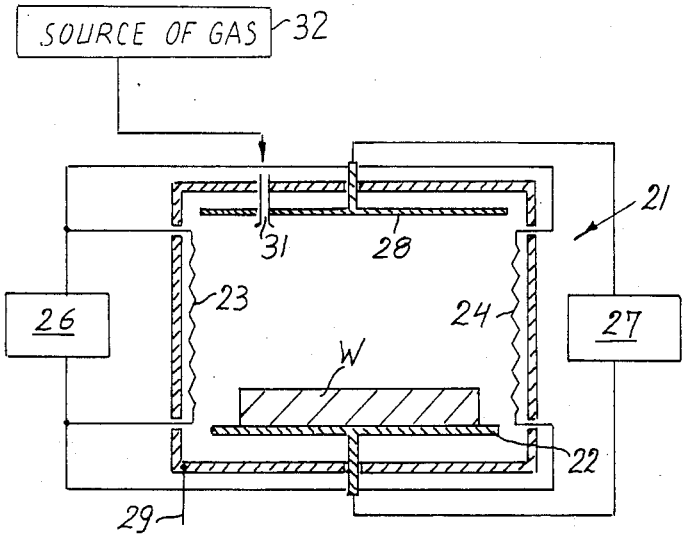
FIG. 2 is a partly diagrammatic sectional view of one embodiment of that portion of the apparatus which is utilized to carry out the nitroding or carburizing step.

The workpiece W, whose surface is provided with a layer of iron boride, is thereupon subjected to a nitriding or carburizing treatment, e.g., in a manner as shown in FIG. 2. The structure of FIG. 2 comprises a vacuum furnace 21 which contains a first electrode (cathode) 22 constituting a support for the boron-treated workpiece W and a second electrode (anode) 28 which is spaced apart from the electrode 22 and from the workpiece. The vacuum furnace 21 further contains means for heating the workpiece W on the electrode 22, and such heating means comprises electric heating elements 23, 24 which are connected to a suitable source 26 of electrical energy. For example, the workpiece W on the electrode 22 can be. heated to a temperature of between 600° and 1050° C., particularly to a temperature of approximately 950° C.

The electrodes 22, 28 are connected to a source 27 of high-voltage energy to establish a glow discharge so that the workpiece W is disposed in a plasma that develops adjacent to the cathode 22. The furnace 21 is preferably lined with an internal layer 29 of suitable insulating material. A conduit 31 admits a gaseous treating agent which contains nitrogen. When the workpiece W is heated to a desired temperature (e.g., 950° C.), the conduit 31 admits the gaseous agent from a suitable source 32 while the source 27 applies high voltage to the electrodes 22 and 28 so that the workpiece W is located in the plasma as a result of glow discharge between the two electrodes. This entails a nitriding of the surface of the workpiece which, at the start of treatment in the furnace 21, already exhibits a layer of iron boride. Such nitriding greatly enhances the hardness of the surface layer of the workpiece W. The furnace 21 may be a hardening furnace with glow discharge of the type manufactured and sold by KLÖCKNER IONON GMBH, Leverkusen, German Federal Republic.

If the workpiece W is to be carburized, the conduit 31 admits a different gas, e.g., methane. The boron-treated surface of the workpiece W is then carburized and its surface hardness is enhanced.

Instead of boron carbide, the annealing box of FIG. 1 can also contain amorphous boron, ferroboron or another metal-boron compound. When the furnace 21 of FIG. 2 is used for nitriding, the heating elements 23, 24 are preferably caused to heat the workpiece W to a temperature of between 600° and 950° C. If the furnace 21 is used for carburizing, the temperature of the workpiece can be raised to 1050° C.

The improved method can be used with advantage for surface hardening of a wide variety of simple, complex, small, bulky, thin, thick, solid or hollow workpieces. It has been found that a treatment with boron, followed by itriding or carburizing, results in surprisingly satisfactory and pronounced increase in hardness and wear-resistance of ferrous workpieces.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of hardening the surface of a ferrous workpiece, comprising a first step of treating the surface of the workpiece with boron with attendant formation of iron boride having a hardness in excess of 1000 HV; and a second step of carburizing the thus treated surface, including positioninf the workpiece in the plasma of a glow discharge.

2. The method of claim 1, wherein said first step includes confining the workpiece in a boron-containing medium and heating the medium and the workpiece.

3. The method of claim 2, wherein the boron-containing medium is a flowable solid substance.

4. The method of claim 2, wherein the boron-containing medium is a paste.

5. The method of claim 1, wherein said second step further comprises heating the workpiece to a temperature of between 600° and 1050° C.

6. The method of claim 5, wherein said temperature is approximately 950° C.

* * * * *